United States Patent [19]

Collens

[11] Patent Number: 4,669,613

[45] Date of Patent: Jun. 2, 1987

[54] MEDICAL REMINDER DEVICE

[76] Inventor: Richard Collens, 613 Pinebrook Blvd., New Rochelle, N.Y. 10804

[21] Appl. No.: 796,584

[22] Filed: Nov. 8, 1985

Related U.S. Application Data

[62] Division of Ser. No. 558,964, Dec. 7, 1983, Pat. No. 4,533,670, which is a division of Ser. No. 316,917, Oct. 30, 1981, abandoned, which is a division of Ser. No. 123,011, Feb. 20, 1986, abandoned.

[51] Int. Cl.[4] ..... B65D 85/56

[52] U.S. Cl. ..... 206/534; 206/461; 206/539

[58] Field of Search ..... 206/461, 534, 813, 820, 206/535, 538, 539, 531, 532

[56] References Cited

U.S. PATENT DOCUMENTS

| | | | |
|---|---|---|---|
| 2,925,675 | 2/1960 | Lumpkin | 206/813 |
| 3,003,273 | 10/1961 | Tapper | 206/535 |
| 3,111,220 | 11/1963 | Bostrom | 206/534 |
| 3,570,707 | 3/1971 | Finkel | 206/534 |
| 3,610,411 | 10/1971 | Coleman | 206/813 |
| 3,856,144 | 12/1974 | Kelly | 206/531 |
| 3,876,269 | 4/1975 | Fisher et al. | 206/534 |
| 4,211,329 | 7/1980 | Braverman | 206/534 |

FOREIGN PATENT DOCUMENTS

| | | | |
|---|---|---|---|
| 0440117 | 1/1927 | Fed. Rep. of Germany | 206/539 |

*Primary Examiner*—William Price
*Assistant Examiner*—Jimmy G. Foster
*Attorney, Agent, or Firm*—Diller, Ramik & Wight

[57] ABSTRACT

A reminder device comprising a support on which are located at least two different medicinal substances each of said drugs being in single dose form and an instruction bearing portion on said support adjacent each dose to receive instructions for the use thereof.

1 Claim, 2 Drawing Figures

MEDICAL REMINDER DEVICE

This application is a division of application Ser. No. 558,964, filed Dec. 7, 1983 and now U.S. Pat. No. 4,533,670, which is a divisional of Ser. No. 316,919 filed Oct. 30, 1981 (abandoned: which is a divisional of Ser. No. 123,011 of Feb. 20, 1980 (abandoned)

This invention relates to a medical reminder device which can be used by a doctor or pharmacist as a reminder to a patient as to how at least two different medicinal substances each of which is in single dose form are to be taken by the patient under different conditions.

At the present time when a doctor or pharmacist issues at least two different forms of medicine it is usual for them to be provided in separate containers, such as boxed or bottles which are marked with instructions for the patient. Thus, the medicines might include one form of drug which is in encapsulated form, one capsule being taken at bedtime and another form of drug made into pills which are, for example, to be taken once every six hours. In these circumstances it is easy for the patient to forget how to take the drugs and the present invention is intended to provide a reminder device bearing instructions for taking each of the drugs of a particular course of treatment.

According to the present invention therefore a medical reminder device comprises a support on which are located at least two different medicinal substances each of said substances being in single dose form and an instruction bearing portion on said support adjacent each dose to receive instructions for the use thereof.

Thus, the doctor or pharmacist can place the various substances on the support and write the necessary instructions alongside each medicinal substances as required.

The user now has examples of all the drugs and all the instructions in a simple pack.

Preferably each dose is carried in separate location means provided on said support and in a convenient construction each location means can be in the form of a transparent container.

The support can be in sheet form with said doses being located towards one side edge thereof.

With this kind of construction the containers may conveniently be provided by a plastics material blister wrap secured to a backing and which can be filled and closed from the rear surface of said backing.

The rear surface of said support can be provided with attachment means for securing it to a vertical surface so that the pack can be attached, for example, to a medicine cupboard.

Thus, the rear surface can be provided with a self-adhesive attachment means.

The invention can be performed in many ways but one embodiment will now be described by way of example and with reference to the accompanying drawings in which.

Figure 1:
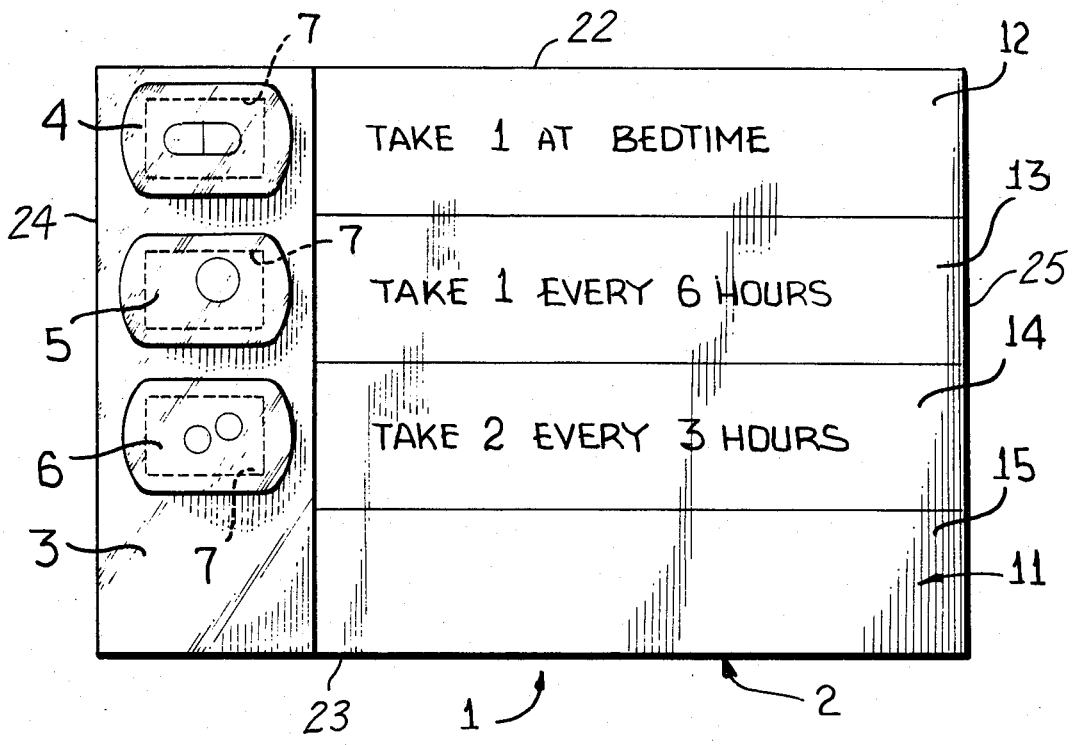
FIG. 1 is a plan view of a reminder device according to the invention.
Figure 2:
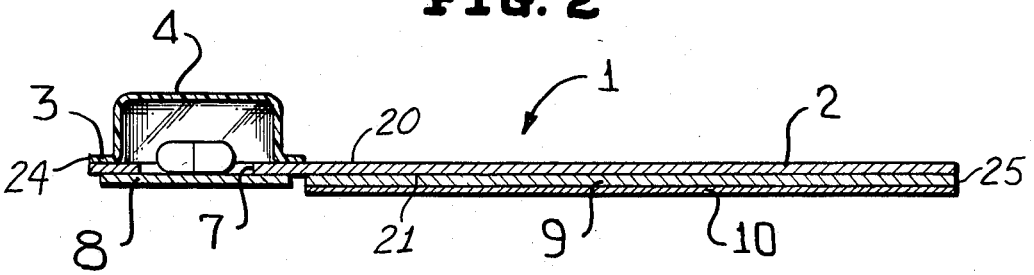
FIG. 2 is a cross-sectional view taken on the lines II—II of FIG. 1.

As shown in the drawings the reminder device according to the invention comprises a support 1 which consists of a flat cardboard backing sheet 2 to one end of which is attached a plastics material blister wrap or sheet 3. The technique of making and attaching such wraps is well known and will not therefore be further described. The backing sheet 2 includes a front surface 20, a rear surface 21, an upper edge 22, a lower edge 23 and opposite side edges 24, 25. The blister wrap or sheet 3 provides three transparent blisters or bubbles indicated by reference numbers 4, 5, and 6 in FIG. 1. The cardboard sheet 2 is cut away to provide along the side edge 24 a plurality of spaced openings or apertures 7 behind each of the bubbles 4, 5 and 6 and an adhesive sealing strip 8 is provided on the rear face or surface 21 of the sheet 2 to seal the openings to thereby render the medicine/medicinal substances therein substantially unremovable and nondispensable therefrom.

Also provided on the rear face or surface 21 is a self-adhesive attaching means sheet 9 which has a cover strip 10.

The front face 11 of the cardboard sheet 2 is marked to provide three intruction bearing portions 12, 13 and 14 by appropriate printing or other marking, although obviously, the size of the sheet 2 may be such as to accomodate additional instruction bearing portions, such as the portion 15 presently devoid of instructions. As will be seen from FIG. 1 each of the instruction bearing portions is adjacent to and aligned with one of the bubbles 4, 5 and 6.

Reminder devices of this kind can be supplied to doctors, druggists and pharmacists so that when they wish to prescribe a particular course of treatment the particular medicines or medicinal substances in single dose form can be placed in the blisters 4, 5 and 6 and appropriate instructions written in the spaces 12, 13 or 14 alongside each dose. In the made up pack shown in the drawings bubble 4 carries a capsule containing a drug and the instructions "take one at bedtime" are written alongside. Bubble 5 is provided with a pill with the instructions "take one every six hours" and bubble 6 is also provided with a pill of a different type with the instructions "take two every three hours".

To keep the pack in a readily useable location the cover strip 10 can be removed from the adhesive backing 9 thus enabling the pack to be attached, for example, to a medicine cabinet.

A patient need only to refer to the reminder device 1 at anytime of the day or night and the same will readily remind him which medication need be taken at a particular time or interval. At such time he need but select the appropriate medication from its respective conventional container. In this manner the remainder device 1 functions soley as a reminder to the patient, and the medication in the blisters 4,5,6 is at no time removed thereform for consumption.

I claim:

1. A device for correlating substantially nondispensable medicinal substances carried by said device with identical substantially dispensable ingestible medicinal substances located separately from and physically disassociated relative to said device thereby to remind a person of the particular substantially dispensable ingestible medicinal substances which are to be taken under prescribed conditions comprising:

(a) a flat backing sheet, said backing sheet having front and rear surfaces, upper and lower edges and opposite side edges, said backing sheet having a plurality of spaced apertures along one of said side edges, said apertures each being sized for allowing ingress of a single discrete medicinal substance and small enough to extend only a minor portion of the distance between said opposite side edges;

(b) a plastic blister sheet being located along one side edge of said backing sheet, said blister sheet extending substantially the full distance between the upper and lower edges and extending only a minor portion of the distance between the side edges of said backing sheet, said blister sheet having a plurality of blisters therein spaced wherein each blister overlies a single one of said apertures, each blister being sized to completely cover a respective one of said apertures and its perimeter, said blisters extending frontwardly of said backing sheet;

(c) a sealing strip adhesively attached to the rear surface of said backing sheet, said sealing strip being located and configured in such a manner that it seals the openings of said backing sheet but extends across only a minor portion of the distance between the opposite side edges of said backing sheet;

(d) a self-adhesive attaching means where attaching the device to a surface, said attaching means being secured to the rear surface of said backing sheet on at least a portion of said rear surface not attached by said sealing strip;

(e) a cover sheet being connected to a surface of said attaching means opposite of said backing sheet, said cover sheet substantially covering said opposite surface, wherein a remainder of the front surface of said backing sheet not attached by said blister sheet is suitable for receiving indicia; and (f) each blister housing a discrete medicinal substance thereunder.

* * * * *